US009577382B2

(12) United States Patent
Kida

(10) Patent No.: US 9,577,382 B2
(45) Date of Patent: Feb. 21, 2017

(54) CONNECTOR

(71) Applicant: Sumitomo Wiring Systems, Ltd., Yokkaichi, Mie (JP)

(72) Inventor: Shinjiro Kida, Mie (JP)

(73) Assignee: SUMITOMO WIRING SYSTEMS, LTD., Yokkaichi, Mie (JP)

( * ) Notice: Subject to any disclaimer, the term of this patent is extended or adjusted under 35 U.S.C. 154(b) by 0 days.

(21) Appl. No.: 15/096,312

(22) Filed: Apr. 12, 2016

(65) Prior Publication Data

US 2016/0336689 A1 Nov. 17, 2016

(30) Foreign Application Priority Data

May 11, 2015 (JP) ..... 2015-096362

(51) Int. Cl.

| | |
|---|---|
| ***H01R 13/627*** | (2006.01) |
| ***H01R 3/00*** | (2006.01) |
| ***H01R 13/641*** | (2006.01) |
| ***H01R 13/639*** | (2006.01) |

(52) U.S. Cl.

CPC ..... *H01R 13/641* (2013.01); *H01R 13/6272* (2013.01); *H01R 13/639* (2013.01)

(58) Field of Classification Search

CPC ..... H01R 13/639; H01R 13/641; H01R 13/64
See application file for complete search history.

(56) References Cited

U.S. PATENT DOCUMENTS

| | | | | |
|---|---|---|---|---|
| 5,425,656 | A * | 6/1995 | Wakata | H01R 13/4365 439/595 |
| 5,910,028 | A * | 6/1999 | Tsuji | H01R 13/641 439/354 |
| 6,109,955 | A * | 8/2000 | Hanazaki | H01R 13/641 439/352 |
| 6,247,957 | B1 * | 6/2001 | Hasegawa | H01R 13/639 439/352 |
| 6,575,775 | B2 * | 6/2003 | Hasegawa | H01R 13/41 439/188 |
| 6,712,635 | B1 * | 3/2004 | Nimura | H01R 13/641 439/352 |
| 6,887,106 | B2 * | 5/2005 | Noguchi | H01R 13/65802 439/607.41 |

(Continued)

FOREIGN PATENT DOCUMENTS

JP 2015-32506 2/2015

*Primary Examiner* — Briggitte R Hammond
(74) *Attorney, Agent, or Firm* — Gerald E. Hespos; Michael J. Porco; Matthew T. Hespos

(57) ABSTRACT

A stopper (67) of a detector (60) is lockable to a lock surface (17) by entering a lock hole (18) of a lock arm (13) from a deflection space 15. A locking protrusion (45) of a second housing (40) locks to the lock surface (17) by entering the lock hole (18) from a side opposite the deflection space (15). Thus, the housings (10, 40) are held together and the stopper (67) pressed by the locking protrusion (45) separates from the lock surface (17) and the detector can move to the detection position. The locking protrusion (45) has a main body (46) wider than the lock surface (17) of a lock projection (16) and lockable to the lock surface (17). A pressing protrusion (47) narrower than the locking main body 46 projects from the locking main body (46) and enters the lock hole (18) to press the stopper (67).

7 Claims, 10 Drawing Sheets

(56) References Cited

U.S. PATENT DOCUMENTS

| | | | | |
|---|---|---|---|---|
| 2002/0052135 | A1* | 5/2002 | Noguchi ..... | H01R 13/4367<br>439/352 |
| 2015/0037998 | A1 | 2/2015 | Kataoka et al. | |

* cited by examiner

CONNECTOR

BACKGROUND

1. Field of the Invention. The invention relates to a connector and to an assembling method therefor.

2. Description of the Related Art. Japanese Unexamined Patent Publication No. 2015-32506 discloses a connector with a male housing having a receptacle and a female housing that can fit into the receptacle. A detector is mounted in the female housing and is movable between an initial position and a detection position. A lock protrusion is provided on the inner surface of the receptacle. The female housing includes a deflectable lock arm and the lock arm is provided with a lock projection and two couplings that extend back from both sides of the lock projection. The lock arm has a lock hole between the lock projection and the couplings. The front surface of the lock hole (also rear surface of the lock projection) is formed as a lock surface. Further, a resilient arm projects from the detecting member and a protrusion is provided on a tip part of the resilient arm.

When the detector is at the initial position, the protrusion is inserted into the lock hole from below and locked by the lock surface. Thus, a movement of the detector to the detection position is regulated. Further, when the two housings are connected properly, the lock protrusion is inserted into the lock hole from above (side opposite to the deflection space) and is locked by the lock surface so that the two housings are held in a state where separation is regulated and the protrusion pressed by the lock protrusion is released from locking by the lock surface and retracted into the deflection space to permit a movement of the detector to the detection position. Thus, it can be known that the two housings have been connected properly when the movement of the detector to the detection position is enabled.

There have been cases where the lock arm hangs down from a normal position and the deflection space for the lock arm becomes narrower than normal due to deterioration over time, distortion during molding or the like. Then, the lock surface also is lowered by the hanging-down of the lock arm. Thus, even if the protrusion is pushed down by the lock protrusion when the two housings are connected properly, the protrusion cannot be separated sufficiently from the lock surface, the detector may interfere with the lock surface or the lower surface of the lock arm while moving toward the detection position and an operation of moving the detector to the detection position may be regulated.

The invention was completed based on the above situation and aims detection position.

SUMMARY

The invention relates to a connector with a first housing including a deflectable lock arm. A detector is mounted in the first housing and is movable from a first position to a second position. A second housing is connectable to the first housing. The lock arm includes at least one lock projection having a lock surface extending along a direction intersecting a connecting direction of the first and second housings and a lock hole closed at one end by the lock surface. The second housing includes a locking protrusion and the detector includes a stopper. The stopper is arranged to lock to the lock surface by being inserted into the lock hole from the side of a deflection space for the lock arm when the detector is at the first position. Thus, a movement of the detector to the detection position is regulated. The locking protrusion is arranged to lock with the lock surface by being inserted into the lock hole from a side opposite to the deflection space when the first and second housings are connected properly. Thus, the first and second housings are held in a state where separation is regulated and the stopper pressed by the locking protrusion is separated from the lock surface and is retracted into the deflection space to permit the movement of the detector towards or to the second position. The locking protrusion includes a pressing protrusion configured to press the stopper by entering the lock hole when the first and second housings are connected properly.

The locking protrusion may include a locking main body lockable to the lock surface and a pressing protrusion projecting from a projecting end of the locking main body.

A width direction extends substantially orthogonal to a projecting direction of the lock projection and also orthogonal to the connecting direction of the first and second housings. The locking main body has a larger dimension in the width direction than the lock surface of the lock projection and is lockable to the lock surface. Additionally, the pressing protrusion has a smaller dimension in the width direction than the locking main body. The pressing protrusion of the locking protrusion enters the lock hole from the side opposite to the deflection space and presses the stopper when the first and second housings are connected properly. Thus, the stopper can be separated reliably from the lock surface by being caused to sink deep into the deflection space, and interference of the detector and the lock arm can be reduced or eliminated when the detector moves to the detection position. As a result, the detector can move smoothly to the detection position. Further, the locking main body of the locking protrusion is wider than the lock surface of the lock projection and is lockable to the lock surface. Thus, a sufficient locking margin of the locking main body to the lock surface of the lock projection can be ensured and the state where the separation of the first and second housings is regulated can be held reliably.

One or more extension parts may protrude from the lock projection toward opposite widthwise sides of the lock projection. The extension parts may be lockable to the lock surface of the lock projection over the substantially entire width when the first and second housings are connected properly. According to this configuration, a sufficient locking margin of the locking main body to the lock surface of the lock projection can be ensured more reliably.

A width of the lock hole may be substantially equal to that of the lock surface of the lock projection and/or smaller than that of the locking main body of the locking protrusion.

The first housing may comprise one or more guide walls to project laterally of the lock arm so as to guide the detector on the first housing.

At least one elongated projection may be provided on the guide wall of the first housing and may extend substantially in the front-back direction so that when the first and second housings are in proper postures, the elongated projection can fit into an elongated projection receiving portion on the second housing. However, if the first and second housings are in postures different from the proper ones, the elongated projection contacts the second housing to prevent an erroneous connection of the first and second housings.

These and other objects, features and advantages of the invention will become more apparent upon reading the following detailed description and accompanying drawings.

DETAILED DESCRIPTION

An embodiment of the invention is described with reference to FIGS. 1 to 11. A connector of this embodiment includes a first housing 10 and a second housing 40 connectable to each other and a detector 60 is mounted in or to the first housing 10 is movably between a standby position and a detection position. Note that, in the following description, sides facing each other when the connection of the first and second housings 10, 40 is started are referred to as front sides concerning a front-back direction and a vertical direction is based on FIGS. 1 to 5, 7 and 9.

Figure 8:
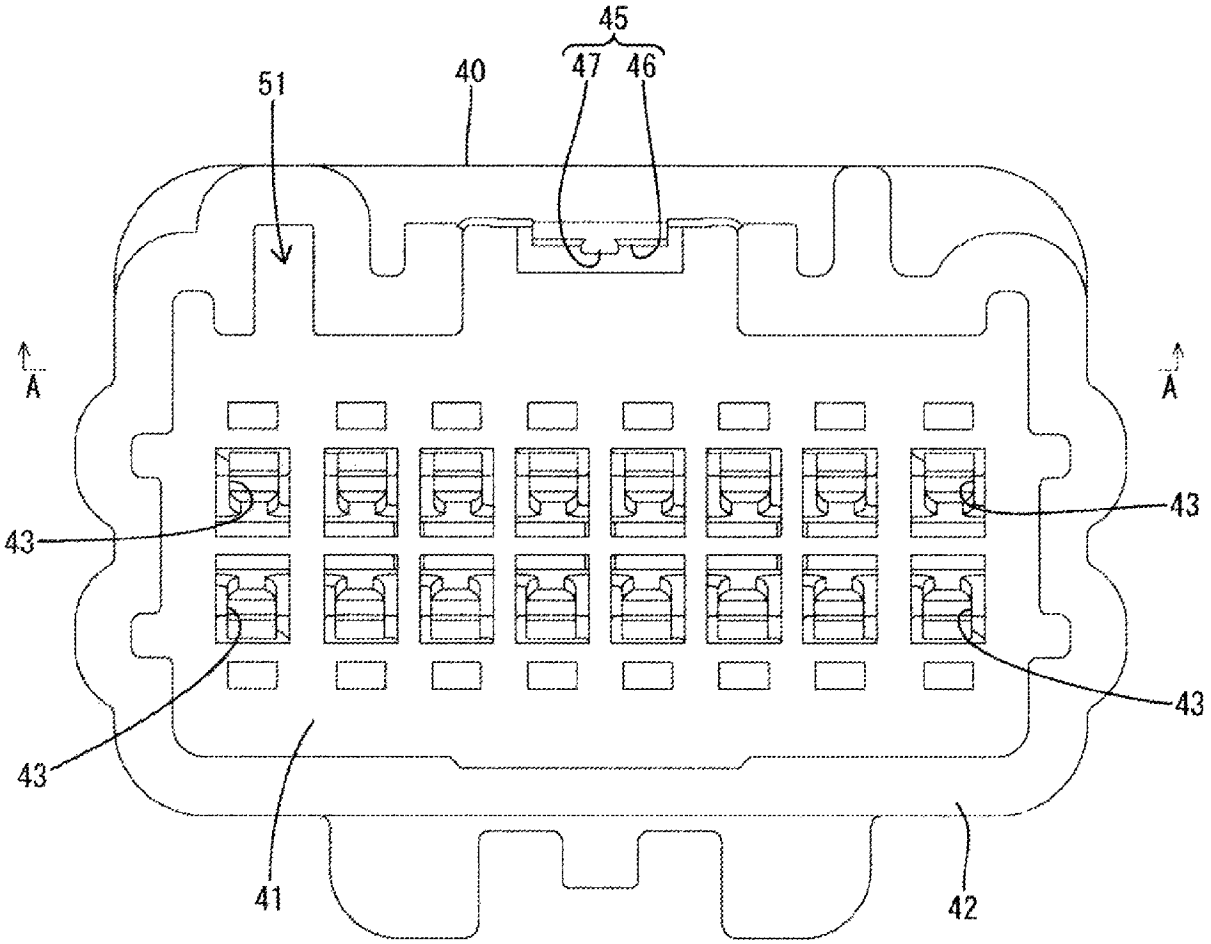
FIG. 8 is a front view of the second housing.
Figure 9:
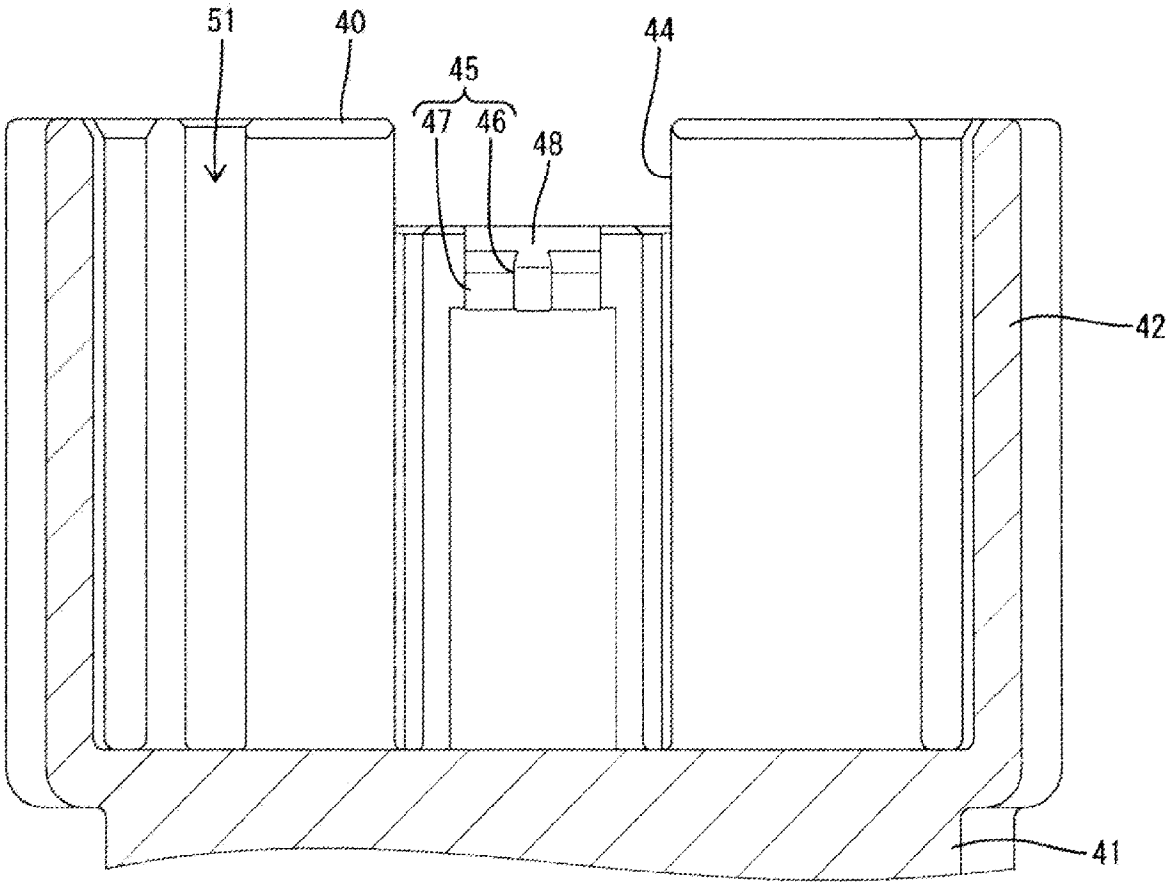
FIG. 9 is a section along A-A of FIG. 8.

The second housing 40 is made e.g. of synthetic resin and includes a terminal accommodating portion 41 in the form of a substantially rectangular block and a substantially rectangular tubular receptacle 42 projects forward from the outer periphery of the front end of the terminal accommodating portion 41, as shown in FIGS. 8 and 9. Second cavities 43 (see FIG. 8) are provided in the terminal accommodating portion 41 and unillustrated male terminal fittings are inserted therein so that tabs of the male terminal fittings project into the receptacle 42.

As shown in FIG. 9, a substantially rectangular recess 44 is recessed slightly backward in a widthwise intermediate part of the front end of the upper wall of the receptacle 42. A locking protrusion 45 is provided right behind the recess 44 on the inner surface of the upper wall of the receptacle 42. As shown in FIG. 8, the locking protrusion 45 comprises a locking main body 46 in the form of a flat rectangular block projecting from the inner surface of the receptacle 42 and extending in a width direction. A pressing protrusion 47 projects integrally or unitarily down and in from a central part of the locking main body 46 in the width direction orthogonal to a connecting direction of the first and second housings 10, 40 and a projecting direction of the locking protrusion 45 (downward direction). A dimension in the width direction of the pressing protrusion 47 is smaller than about ⅓ of the width of the locking main body 46.

Figure 1:
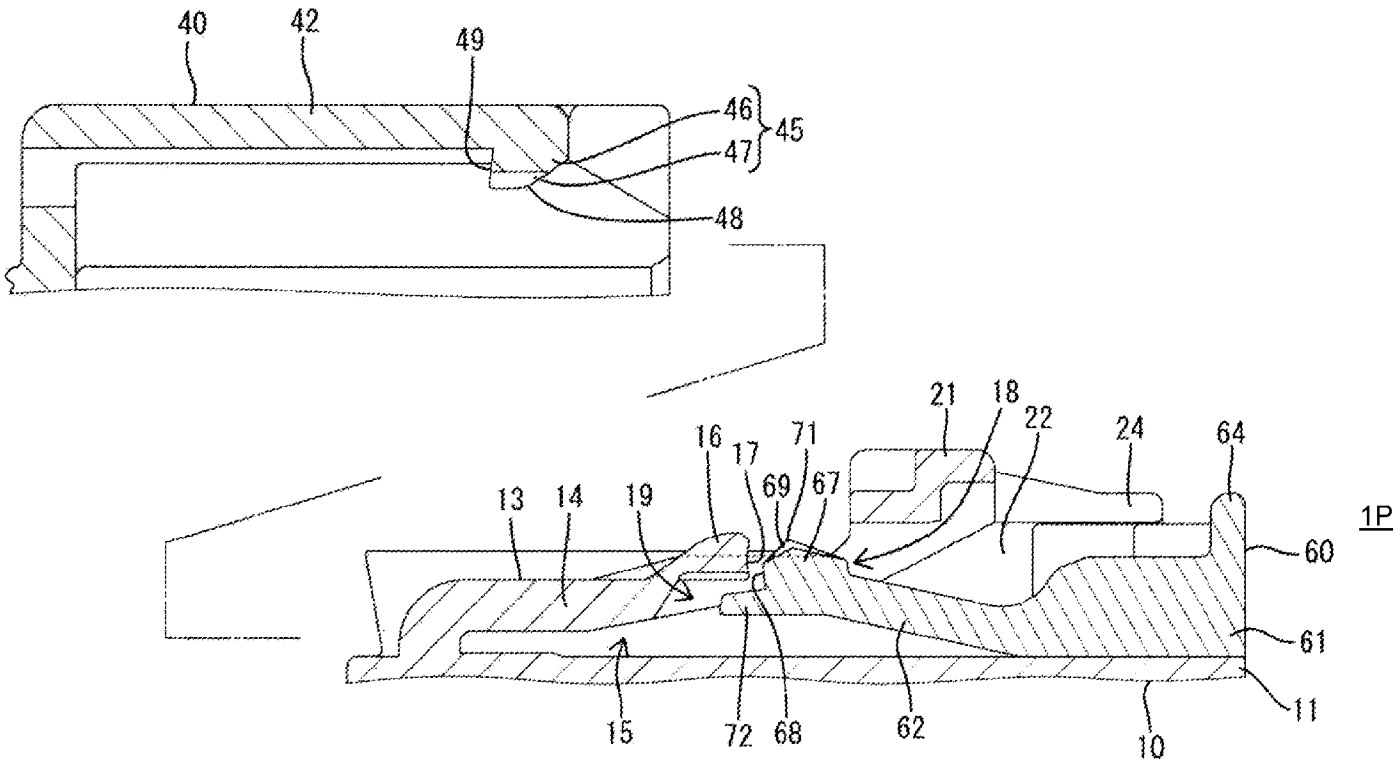
FIG. 1 is a partial enlarged section of a first housing having a detector held at a standby position and a second housing including a locking protrusion in a connector according to an embodiment of the present invention.

As shown in FIG. 1, the front of the locking protrusion 45 forms a tapered guiding surface 48 inclined back toward a lower projecting end. Further, the rear of the locking protrusion 45 defines an overhanging locking surface 49 inclined slightly back toward the lower projecting end. The guiding surface 48 and the locking surface 49 are formed continuously from the locking main body 46 to the pressing protrusion 47 without any step.

Figure 6:
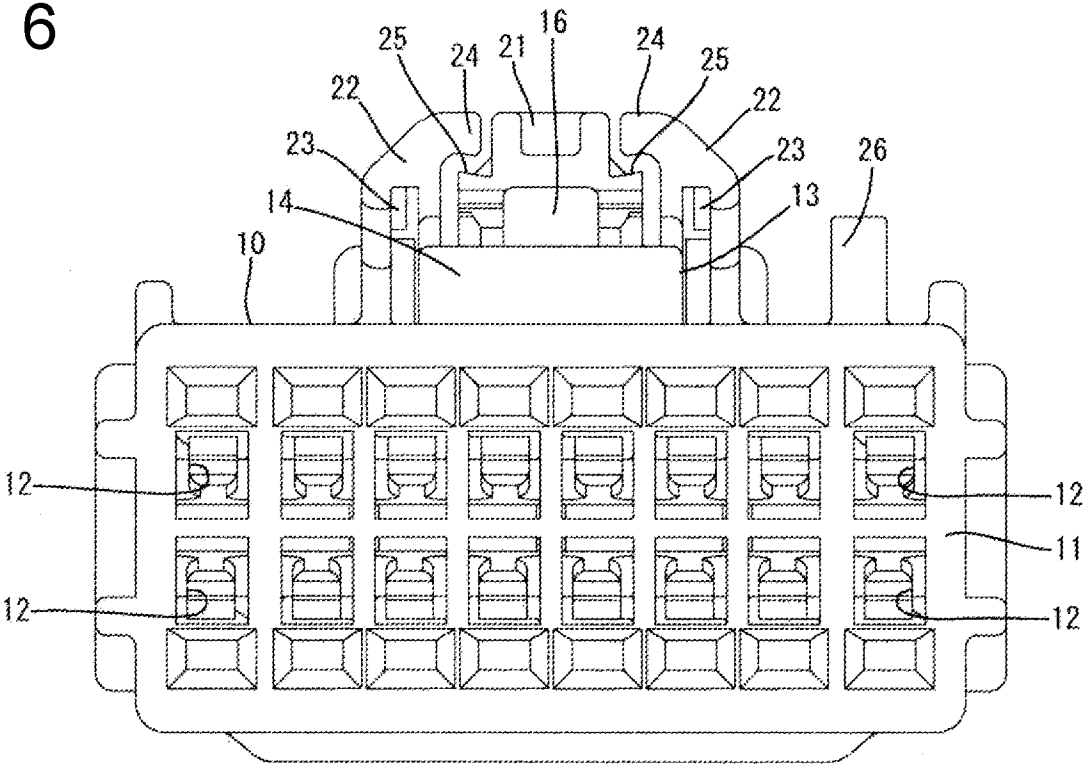
FIG. 6 is a front view of the first housing.
Figure 7:
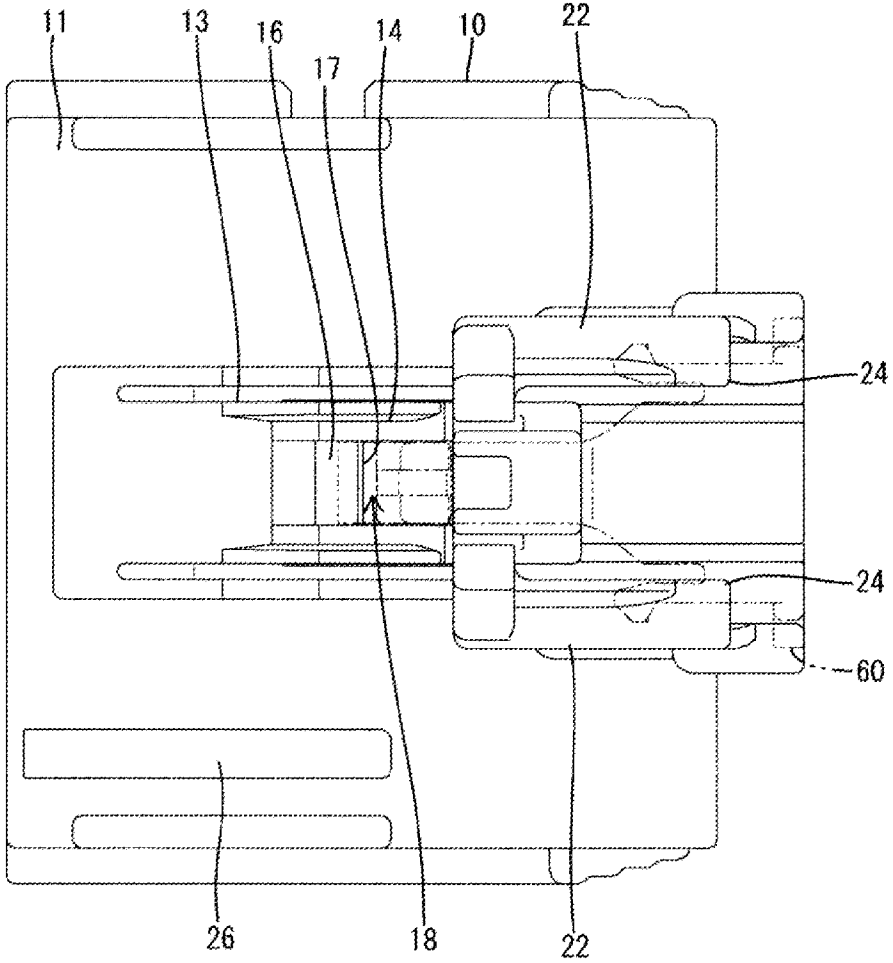
FIG. 7 is a plan view of the first housing.

The first housing 10 is made of synthetic resin and includes a housing main body 11 in the form of a substantially rectangular block, as shown in FIGS. 6 and 7. First cavities 12 are provided in the housing main body 11 at positions corresponding to the second cavities 43, as shown in FIG. 6, and unillustrated female terminal fittings are insertable therein. The male and female terminal fittings are connected electrically when the first and second housings 10, 40 are connected properly.

As shown in FIG. 6, a lock arm 13 projects in a widthwise intermediate part of the upper surface of the housing main body 11. As shown in FIG. 1, the lock arm 13 includes an arm main body 14 that is cantilevered back after standing up from a front end part of the upper surface of the housing main body 11. The arm main body 14 is deflectable and deformable in the vertical direction that intersects the connecting direction, with the standing front end part as a support. A deflection space 15 is formed between the arm main body 14 and the upper surface of the housing main body 11.

As shown in FIG. 1, a lock projection 16 projects out and up in an intermediate part in an extending direction (front-back direction). The rear surface of the lock projection 16 defines a lock surface 17 that is arranged to stand substantially vertically, but a lower end part is inclined slightly backward.

Figure 4:
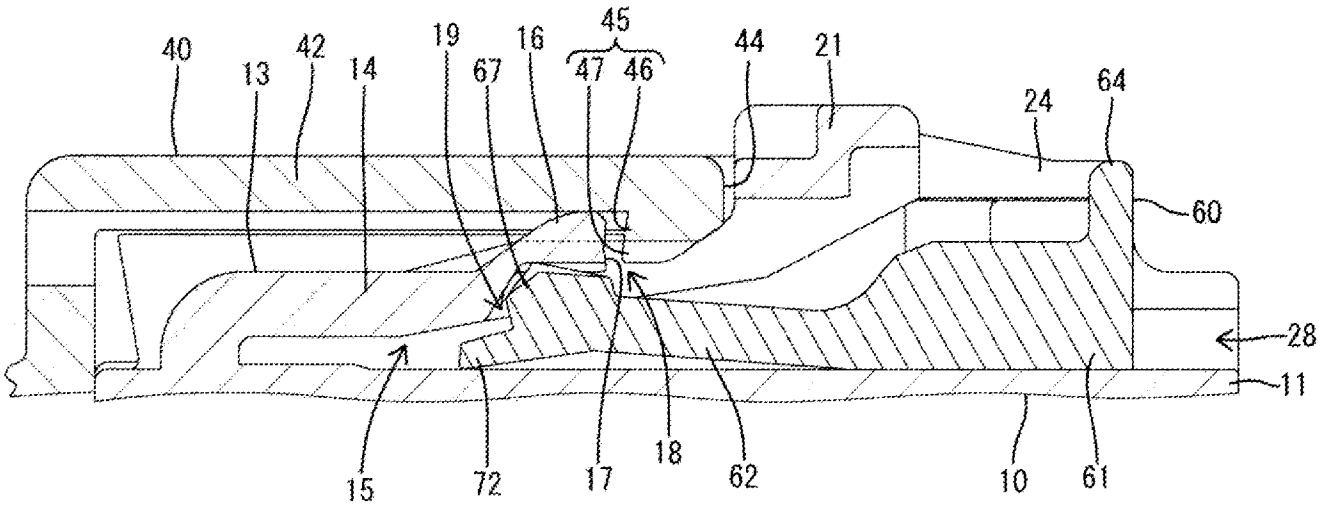
FIG. 4 is a partial enlarged section showing a state where the detector is at a detection position.

A rearwardly open lock hole 18 extends in the front-back direction on the arm main body 14, as shown in FIGS. 4 and 7. The front end of the lock hole 18 is closed by the lock surface 17 of the lock projection 16. As shown in FIG. 7, a width of the lock hole 18 is equal to the width of the lock surface 17 of the lock projection 16 and smaller than the width of the locking main body 46 of the locking protrusion 45. Further, as shown in FIG. 1, the arm main body 14 is provided with an insertion recess 19 below the lock projection 16. The insertion recess 19 communicates with the lock hole 18 and is open on the lower surface of the arm main body 14. A later-described stopper 67 of the detector 60 is insertable into the insertion recess 19.

Further, an unlocking portion 21 is provided at a position on a rear end part of the arm main body 14 to cover a rear end part of the lock hole 18 from above and is slightly higher than the lock projection 16 in the vertical direction. The lock hole 18 penetrates through the arm main body 14 in the vertical direction between the unlocking portion 21 and the lock projection 16.

Figure 3:
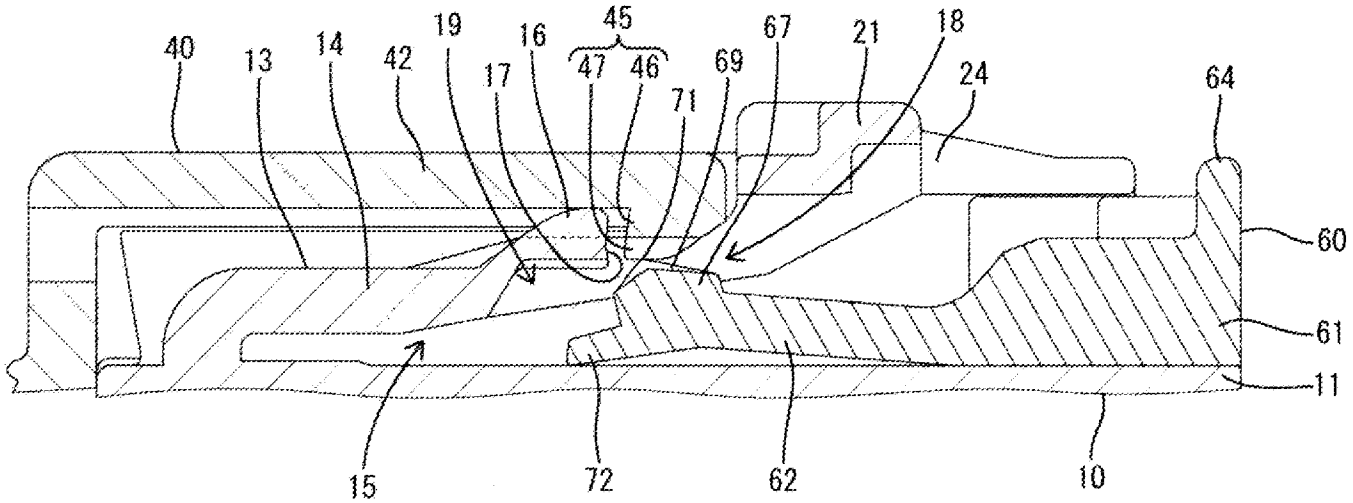
FIG. 3 is a partial enlarged section showing a state where the first and second housings are connected properly and a locking protrusion is pressing a stopper portion of a detector.

The locking protrusion 45 of the second housing 40 faces the lock surface 17 of the lock projection 16 when the first and second housings 10, 40 are connected properly, as shown in FIGS. 3 and 4. Thus, the first and second housings 10, 40 are held in a state where separation is regulated. On the other hand, at the time of separating the first and second housings 10, 40, the unlocking portion 21 is pressed from above after the detector 60 is pulled back to the standby position. The arm main body 14 then is pushed resiliently down and toward the deflection space 15 so that the lock projection 16 is separated from the locking protrusion 45 and the first and second housings 10, 40 enter a separable state. As shown in FIG. 7, guide walls 22 project laterally at opposite widthwise sides of a rear end part of the lock arm 13 on the upper surface of the housing main body 11. The guide walls 22 have parts extending back from the rear end of the lock arm 13 and are arranged on a rear end part of the upper surface of the housing main body 11. The detector 60 is mounted by being inserted between the guide walls 22 into the deflection space 15 for the lock arm 13 and is movable in the front-back direction along the inner surfaces of the guide walls 22 between the standby position and the detection position. Although not shown in detail, holding structures are provided on the inner surfaces of the guide walls 22 for holding the detector 60 at the standby position and the detection position (such as holding portions 23 of FIG. 6).

Further, as shown in FIG. 6, two inversion preventing portions 24 are provided while being bent inward above opposite widthwise end parts of the unlocking portion 21 on upper end parts of the guide walls 22. The inversion preventing portions 24 function to contact with the opposite widthwise end parts of the unlocking portion 21 when the lock arm 13 is going to be deformed in a direction opposite to a proper direction, thereby regulating any further deflection of the lock arm 13. Note that, as shown in FIG. 6, stepped recesses 25 are recessed slightly on the opposite widthwise end parts of the unlocking portion 21 and contact the inversion preventing portions 24.

An elongated projection 26 is provided on the upper surface of the housing main body 11 on one of the opposite widthwise sides of the guide walls 22 and extends in the front-back direction. The elongated projection 26 can fit into elongated projection receiving portion 51 (see FIG. 8) on the inner surface of the upper wall of the receptacle 42 when the first and second housings 10, 40 are in proper postures. On the other hand, if the first and second housings 10, 40 are in an improper posture, the elongated projection 26 contacts the opening edge of the receptacle 42 to avoid a situation where the first and second housings 10, 40 are connected erroneously.

Figure 10:
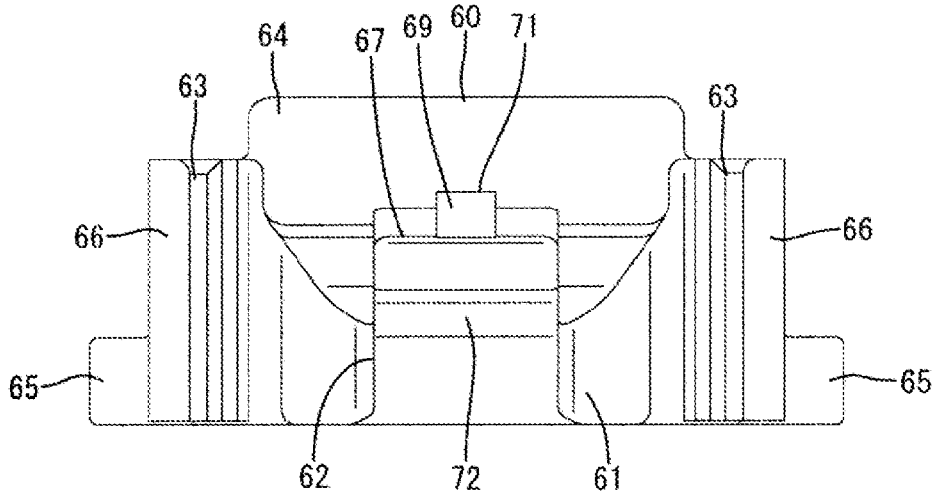
FIG. 10 is a front view of the detector.
Figure 11:
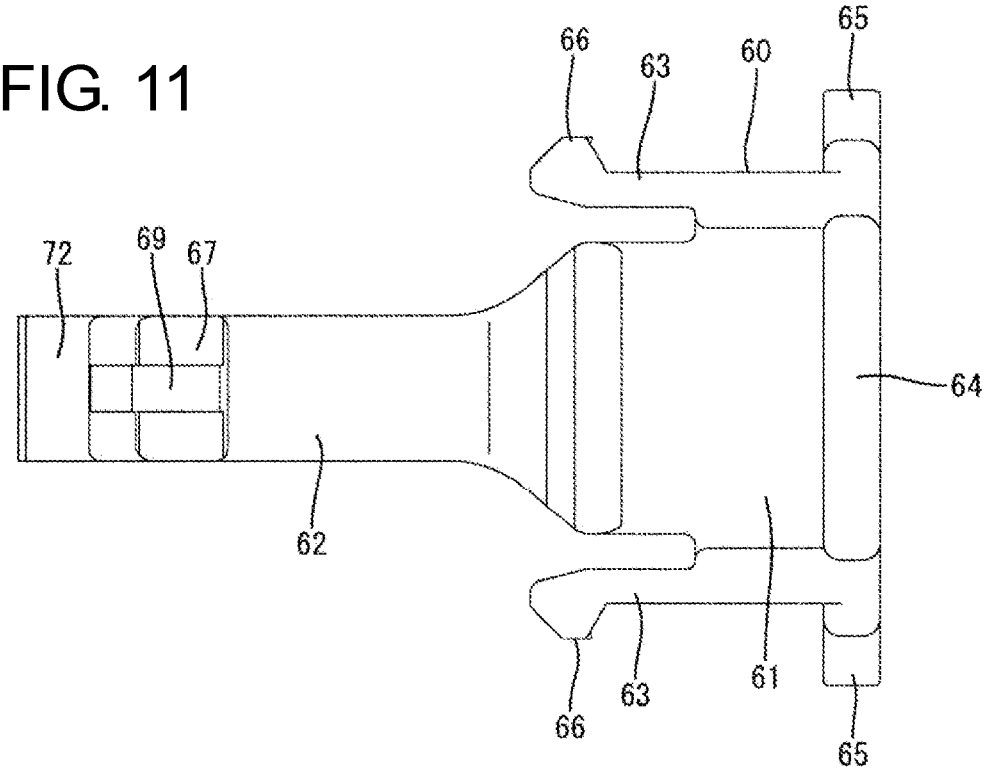
FIG. 11 is a plan view of the detecting member.

The detector 60 is made of synthetic resin and includes, as shown in FIGS. 10 and 11, a thick base 61 extending along the width direction, a resilient arm 62 cantilevered forward from a widthwise central part of the base 61 and two holding pieces 63 that project forward from opposite widthwise ends of the base 61. The detector 60 is slidable forward from the standby position to the detection position relative to the first housing 10.

As shown in FIGS. 10 and 11, a rib-like operating portion 64 projects on the upper end of the base 61 and extends along the width direction. The detector 60 can be moved by pressing or gripping the operating portion 64 from behind. Two guide protrusions 65 are provided on lower edge parts of opposite widthwise end surfaces of the base 61. The detector 60 is guided by fitting the guide protrusions 65 into guide grooves 28 (see FIG. 4) on the inner surfaces of the guide walls 22.

As shown in FIG. 10, the holding pieces 63 are in the form of flat plates substantially along the vertical direction. As shown in FIG. 11, holding projections 66 project out on front end parts of the holding pieces 63. After the holding pieces 63 are deflected in the width direction, the holding projections 66 are lockable to the holding structures such as the holding portions 23 of the guide walls 22.

As shown in FIG. 1, the resilient arm 62 is inclined up toward the front from the front end of the base 61 and is vertically deflectable and deformable with a position coupled to the front end of the base 61 as a support. The stopper 67 projects on a front end part of the resilient arm 62. The front surface of the stopper 67 defines a stopper surface 68 inclined slightly forward toward an upper side. An auxiliary projection 69 extends in the front-back direction in a widthwise central part on the upper surface of the stopper 67. The auxiliary projection 69 has a sharp top 71 on the upper end, and front and rear side surfaces before and behind the top 71 are inclined down to form a triangular cross-sectional shape.

A receiving piece 72 protrudes forward on the resilient arm 28 before the stopper 67. When the lock arm 13 is deflected into the deflection space 15, the receiving piece 72 contacts the inner upper surface of the insertion recess 19 of the lock arm 13 and the resilient arm 62 follows the deflection of the lock arm 13.

The detector 60 is inserted between the guide walls 22 of the first housing 10 from behind and is held at the initial position (see FIG. 1). When the detector 60 reaches the initial position, the stopper 67 of the resilient arm 62 is inserted into the lock hole 18 from below (side of the deflection space 15) and the stopper surface 68 of the stopper 67 faces the lock surface 17 of the lock projection 16 from behind and is lockable to the stopper surface 17. In this way, a movement of the detector 60 to the detection position is regulated. Further, at the standby position, the base 61 is placed on the upper surface of the housing main body 11, the receiving piece 72 is inserted in the insertion recess 19 and the auxiliary projection 69 projects up from the upper surface of the arm main body 14.

Subsequently, the first housing 10 is fitted into the receptacle 42 of the second housing 40.

Figure 2:
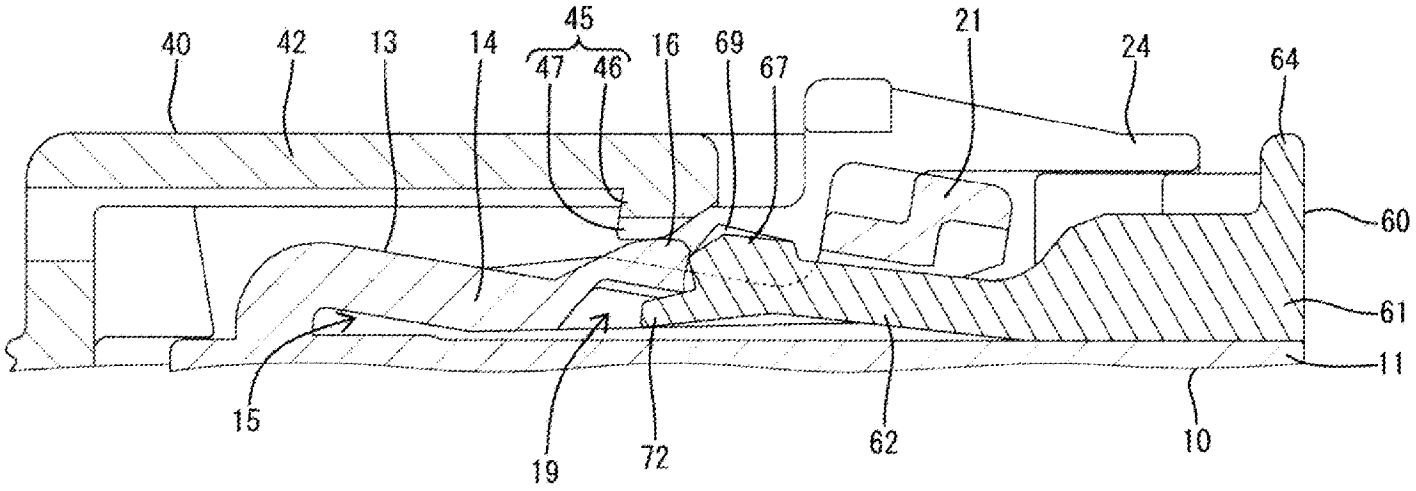
FIG. 2 is a partial enlarged section showing a state where a lock arm is deflected in the process of connecting the first and second housings

As shown in FIG. 2, in the process of connecting the first and second housings 10, 40, the pressing protrusion 47 of the locking protrusion 45 of the second housing 40 contacts the lock projection 16 of the lock arm 13 and the lock arm 13 is deflected in and down. Further, as the lock arm 13 is deflected and deformed, the receiving piece 72 is pressed by the inner upper surface of the insertion recess 19 and the resilient arm 62 is deflected in and down.

As shown in FIG. 3, when the first and second housings 10, 40 are connected properly, the lock projection 16 passes over the locking protrusion 45, the lock arm 13 resiliently returns, the locking protrusion 45 is inserted into the lock hole 18 from above (side opposite to the deflection space 15) and the locking surface 49 of the locking protrusion 45 faces and is lockable to the lock surface 17 of the lock projection 16. In this way, the first and second housings 10, 40 are held in the state where the separation is regulated.

Further, as shown in FIG. 3, with the first and second housings 10, 40 properly connected, the projecting end of the pressing protrusion 47 contacts the top 71 of the auxiliary projection 69 of the stopper 67, and the stopper 67 is pushed in and down while the resilient arm 62 is deflect. In this way, the stopper 67 is separated from the lock surface 17 of the lock projection 16 to enable a movement of the detector 60 to the detection position.

Figure 5:
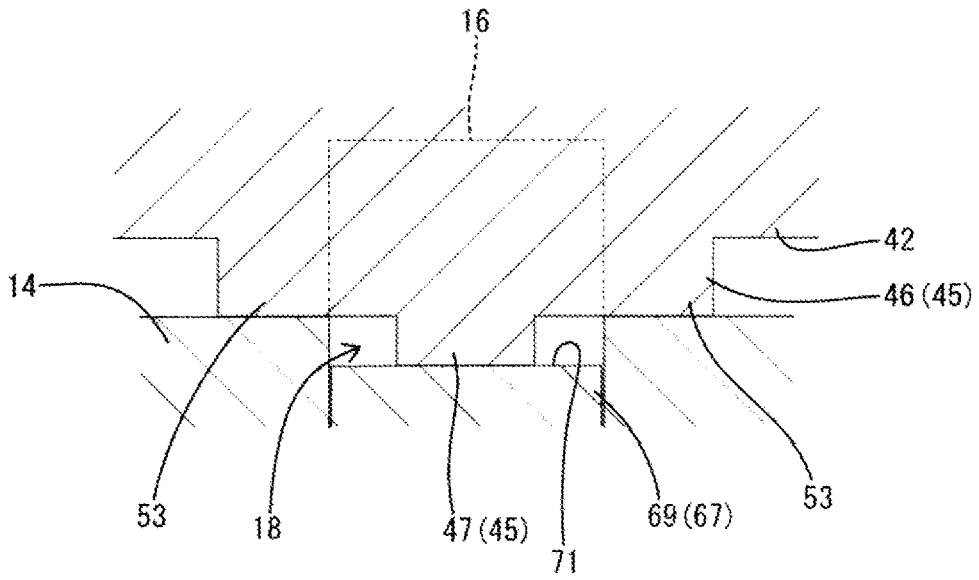
FIG. 5 is a schematic view showing a state corresponding to FIG. 3 when viewed from front.

Specifically, when the first and second housings 10, 40 are connected properly, the pressing protrusion 47 is inserted into the lock hole 18 penetrating through the arm main body 14 as shown in FIG. 5 and contacts the auxiliary projection 69 of the stopper 67 so that the stopper 67 sinks deep into the deflection space 15 and is displaced lower to a height position to be insertable into the insertion recess 19. Further, when the first and second housings 10, 40 are connected properly, the opposite widthwise end parts of the locking main body 46 are arranged to contact the upper surface of the arm main body 14 and lockable to the lock surface 17 of the lock projection 16 over the entire width. At this time, the opposite widthwise end parts of the locking main body 46 are formed as extensions 53 protruding toward substantially opposite widthwise sides of the lock projection 16.

Thereafter, the detector 60 is pushed from behind toward the detection position. In the process of moving the detector 60 toward the detection position, a front oblique part of the auxiliary projection 69 slides in contact with and interferes with the rear end of the lock projection 16, but the stopper 67 and the lock arm 13 do not interfere with each other significantly. Therefore sliding resistance between the lock arm 13 and the detector 60 can be reduced to be small. As shown in FIG. 4, when the detector 60 reaches the detection position, the stopper 67 is separated from the pressing protrusion 47 and fit into the insertion recess 19. Further, when the detector 60 reaches the detection position, the unlocking portion 21 of the lock arm 13 is inserted into the recess 44 and allowed to escape.

On the other hand, if the first and second housings 10, 40 are left without reaching a proper connection position (incompletely connected state), the stopper 67 is kept in a state lockable to the lock projection 16 of the lock arm 13. Thus, the detector 60 cannot be pushed to the detection position. Therefore, it can be judged that the first and second housings 10, 40 have reached the proper connection position when the detector 60 becomes movable to the detection position.

As described above, according to this embodiment, the pressing protrusion 47 of the locking protrusion 45 at least partly is inserted deep into the lock hole 18, whereby the stopper 67 of the detecting member 60 is sufficiently displaced (particularly pushed in and down to be reliably separated from the lock surface 17 of the lock projection 16. Thus, the detector 60 does not interfere with the lock arm 14 when being pushed to the detection position and can be moved smoothly to the detection position. Particularly, it is effective that, even if the lock arm 13 hangs down due to deterioration over time, a molding failure or the like, a hanging-down amount of the lock arm 13 easily can be compensated for by a projecting amount of the pressing protrusion 47.

Further, the locking main body 46 of the locking protrusion 45 is wider than the lock surface 17 of the lock projection 16. Thus, a sufficient locking margin of the locking main body 46 to the lock surface 17 of the lock projection 16 can be ensured when the first and second housings 10, 40 are connected properly. In addition, the locking main body 46 also includes the extensions 53 arranged to be lockable to the lock surface 17 of the lock projection 16 over the entire width and protruding toward the opposite widthwise sides of the lock projection 16. Thus, the locking margin of the locking main body 46 can be ensured more reliably.

Other embodiments are briefly described below.

The detector may be configured to automatically reach the detection position by being biased by at least one biasing member.

The lock hole may be closed over the entire periphery by being closed also on the rear end.

The pressing protrusion may not be provided at such a position to be lockable to the lock surface of the lock projection and may not have a locking function.

The invention is also applicable to a waterproof connector having a sealing structure for sealing between a wire and a housing in a liquid-tight manner.

REFERENCE SIGNS

10 . . . first housing
13 . . . lock arm
15 . . . deflection space
16 . . . lock projection
17 . . . lock surface
18 . . . lock hole
40 . . . second housing
45 . . . locking protrusion
46 . . . locking main body
47 . . . pressing protrusion
53 . . . extension
60 . . . detector
62 . . . resilient arm
67 . . . stopper

What is claimed is:

1. A connector, comprising:

a first housing including a deflectable lock arm;

a detector to be mounted in the first housing and movable from a first position to a second position; and a second housing connectable to the first housing;

wherein:

the lock arm includes at least one lock projection having a lock surface extending along a direction intersecting a connecting direction of the first and second housings and a lock hole closed at one end by the lock surface, the second housing includes a locking protrusion and the detector includes a stopper;

the stopper is arranged to be lockable to the lock surface by being inserted into the lock hole from a side of a deflection space for the lock arm when the detector is at the first position so that a movement of the detector to the detection position is regulated;

the locking protrusion is arranged to be lockable to the lock surface by being inserted into the lock hole from a side opposite to the deflection space when the first and second housings are connected properly so that the first and second housings are held in a state where separation is regulated and the stopper pressed by the locking protrusion is separated from the lock surface and retracted into the deflection space to permit the movement of the detector to the second position; and the locking protrusion includes a pressing protrusion configured to press the stopper by entering the lock hole when the first and second housings are connected properly.

2. The connector of claim 1, wherein the locking protrusion includes a locking main body lockable to the lock surface and a pressing protrusion projecting from a projecting end of the locking main body.

3. The connector of claim 2, wherein the locking main body is wider than the lock surface of the lock projection and is lockable to the lock surface and the pressing protrusion is narrower than the locking main body.

4. The connector of claim 3, wherein the locking main body includes extension parts arranged to lock to the lock surface (17) of the lock projection over substantially an entire width when the first and second housings are connected properly and protruding from the lock projection toward opposite widthwise sides of the lock projection.

5. The connector of claim 1, wherein a width of the lock hole is substantially equal to that of the lock surface of the lock projection and smaller than that of the locking main body of the locking protrusion.

6. The connector of claim 1, wherein the first housing comprises guide walls projecting laterally of the lock arm so as to guide the detector on the first housing.

7. The connector of claim 6, further comprising at least one elongated projection extending in the front-back direction on the guide wall so that when the first and second housings are in proper postures, the elongated projection can fit into an elongated projection receiving portion on the second housing, while if the first and second housings are in improper postures, the elongated projection contacts the second housing preventing an erroneous connection of the first and second housings.

* * * * *